US009518728B2

(12) United States Patent
Lin

(10) Patent No.: US 9,518,728 B2
(45) Date of Patent: Dec. 13, 2016

(54) SPHERE STRUCTURE

(71) Applicant: Wei Hung Lin, New Taipei (TW)

(72) Inventor: Wei Hung Lin, New Taipei (TW)

( * ) Notice: Subject to any disclaimer, the term of this patent is extended or adjusted under 35 U.S.C. 154(b) by 212 days.

(21) Appl. No.: 14/558,685

(22) Filed: Dec. 2, 2014

(65) Prior Publication Data

US 2015/0159858 A1 Jun. 11, 2015

(30) Foreign Application Priority Data

Dec. 11, 2013 (TW) ..... 102145730 A

(51) Int. Cl.
*F21V 33/00* (2006.01)
*A63B 43/06* (2006.01)
*F21Y 101/00* (2016.01)

(52) U.S. Cl.
CPC ..... *F21V 33/008* (2013.01); *A63B 43/06* (2013.01); *F21K 9/61* (2016.08); *F21S 4/22* (2016.01); *F21Y 2101/00* (2013.01)

(58) Field of Classification Search
CPC ..... A63B 43/06; F21K 9/61; F21S 4/22; F21V 33/008; F21Y 2101/00
See application file for complete search history.

(56) References Cited

U.S. PATENT DOCUMENTS 7,210,816 B2 * 5/2007 Lin ..... A63B 43/06 362/234
8,727,918 B1 * 5/2014 Gentile ..... A01K 15/025 473/570
2015/0159846 A1 * 6/2015 Hollinger ..... H05B 33/0806 362/183

FOREIGN PATENT DOCUMENTS

CN 2829805 Y 10/2006
CN 201227503 Y 4/2009
TW M465522 U 11/2013
TW M475297 U 4/2014

* cited by examiner

*Primary Examiner* — Stephen F Husar
(74) *Attorney, Agent, or Firm* — Li & Cai Intellectual Property (USA) Office

(57) ABSTRACT

A sphere structure, of which an inner ball can be disposed with a light source, the sphere structure includes: a groove, formed on the inner ball based on a disposing path, being able to be installed with the light source; a containing portion, formed on the inner ball, being capable of being set with a power supply module, supplying electric power to the light source; and a first cover layer, covering the inner ball constituting an outer surface of the sphere structure, wherein at least one portion of the outer surface is distributed with a light transmitting region, so that the light of the light source is emitted from inside of the sphere structure to outside of the same by passing through the light transmitting region.

14 Claims, 9 Drawing Sheets

SPHERE STRUCTURE

BACKGROUND OF THE INVENTION

1. Field of the Invention

The present disclosure relates to a sphere structure; in particular, to a sphere structure for accommodating a light source such that light from the light source can pass through the surface of the sphere structure and be emitted to the outside environment.

2. Description of Related Art

Many sports use balls. Baseball, for example, is a popular sport in Asia and America. Playing catch is a fun exercise and particularly suitable for brothers, father and son, and friends. However, on weekdays, people usually work or go to school during the day, and only have free time during the evening or at night. Moreover, daytime can be unbearably hot, making playing catch during the evening an even more desirable activity.

However, not all places have sufficient lighting for people to play catch. A baseball is harder than a basketball or volleyball, and travels faster in air. Therefore, under insufficient lighting, playing catch can lead to accidents and injury. Additionally, a baseball is smaller and therefore harder to find when fumbled or failed to be caught in environments of insufficient lighting. Insufficient lighting is a not a problem which can be easily solved by the public. Other than formal competitions, electric power necessary to operate lighting equipment is very costly.

Light-emitting balls exist for people to use in environments of insufficient lighting. These balls are mostly coated with fluorescent material or mounted with fluorescent units which emit light for people to recognize. However, fluorescent material provides weak lighting and takes time for human eyes to identify, and is therefore not an ideal solution for playing catch in the dark. Moreover, fluorescent material coated on the surface of a ball is often smeared on hands, and is harmful to human health. If fluorescent units are mounted on a ball, the structure, material, weight and other specifications of the ball must be modified accordingly to accommodate the fluorescent units. For example, the surface of the ball must be transparent to allow light to pass through, or the fluorescent units must be part of the surface of the ball. These adjustments greatly alter the characteristics of the ball, limiting the ball to being a toy and not a ball for proper practice.

Hence, the present inventor believes the above mentioned disadvantages can be overcome, and through devoted research combined with application of theory, finally proposes the present disclosure which has a reasonable design and effectively improves upon the above mentioned disadvantages.

SUMMARY OF THE INVENTION

The object of the present disclosure is to provide a sphere structure which can accommodate a light source therein and allow light from the light source to be emitted outside the sphere structure through a particular structural arrangement.

In order to achieve the aforementioned object, the present disclosure provides a sphere structure having an inner ball for accommodating a light source, and the sphere structure comprises: a groove formed on the inner ball along a disposing path for accommodating the light source; a containing portion formed on the inner ball for accommodating a power supply module which supplies electric power to the light source; a first cover layer, covering the inner ball to form an outer surface on the inner ball, wherein a portion of the outer surface is formed with a light transmitting region, such that light from the light source can be emitted out of the sphere structure through the light transmitting region.

In summary of the above, the sphere structure of the present disclosure is formed with the groove for accommodating the light source, and light from the light source can be emitted out of the sphere structure through the light transmitting region. In other words, the present disclosure provides a sphere structure which emits light, thereby solving the problem of insufficient lighting in practice fields, such that users can play catch in environments of insufficient lighting.

In order to further the understanding regarding the present disclosure, the following embodiments are provided along with illustrations to facilitate the disclosure of the present disclosure.

DETAILED DESCRIPTION OF THE PREFERRED EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

Figure 1A:
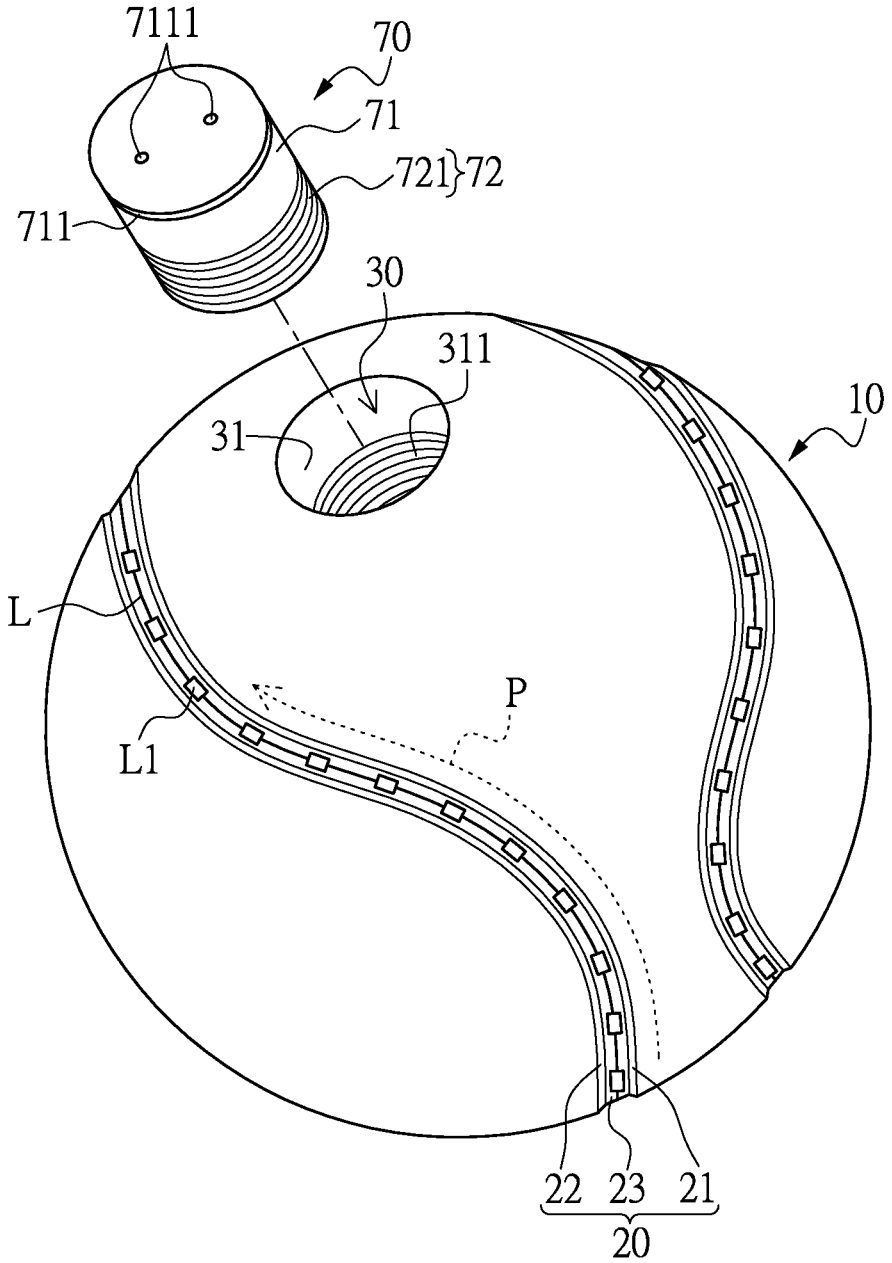
FIG. 1A shows an exploded view of an inner ball according to a sphere structure of the present disclosure.
Figure 1B:
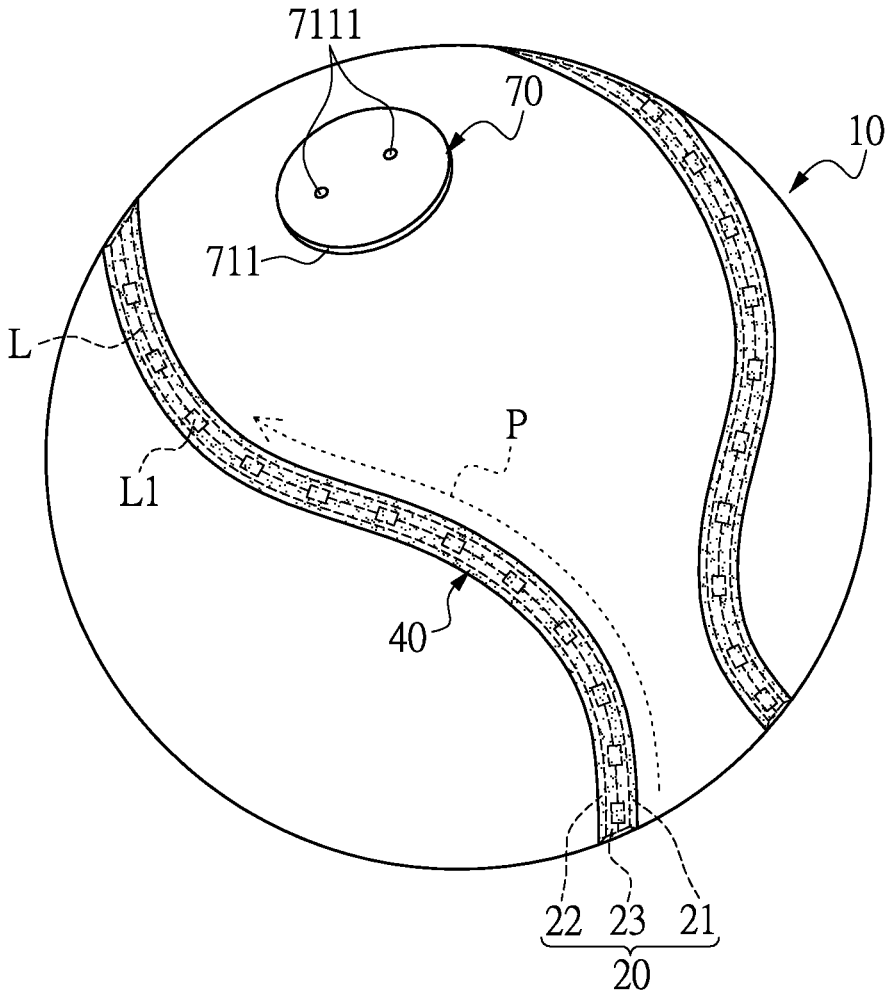
FIG. 1B shows a perspective view of an inner ball according to a sphere structure of the present disclosure.
Figure 1C:
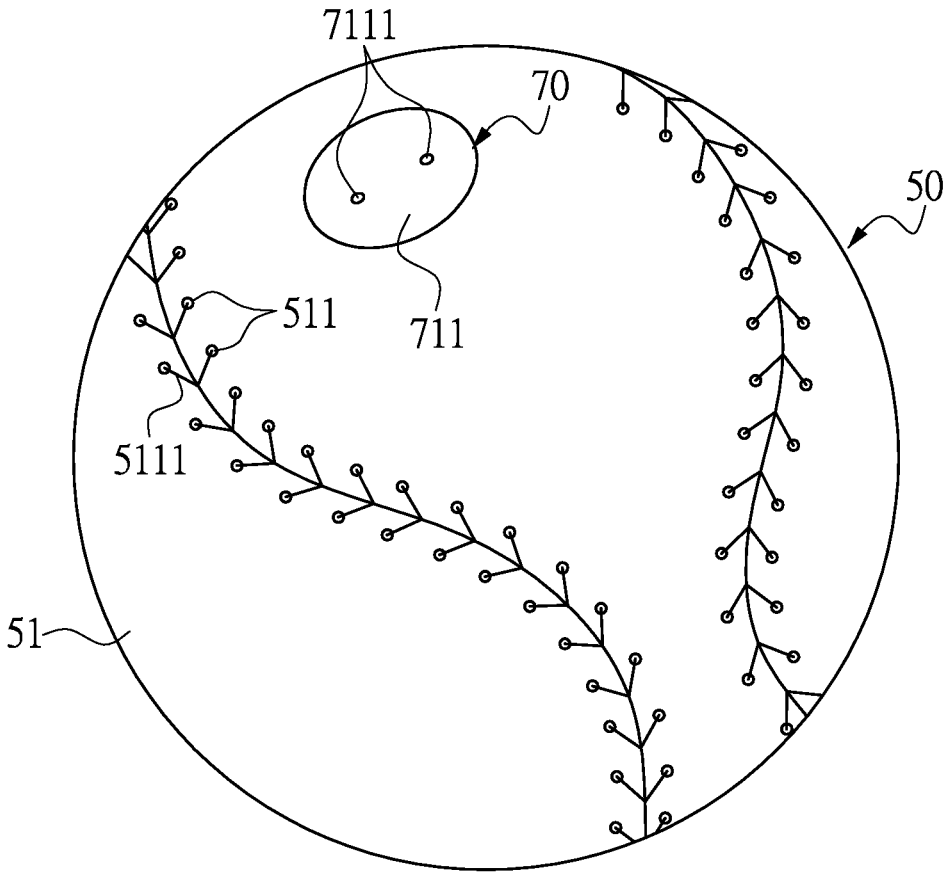
FIG. 1C shows a perspective view of a sphere structure according to the present disclosure.

Referring to FIG. 1A, FIG. 1B and FIG. 1C, the present disclosure provides a sphere structure comprising: a groove 20, a containing portion 30 and a first cover layer 50. Preferably, the sphere structure of the present disclosure is applied to a baseball, but is not limited thereto. The baseball mentioned herein refers to a hardball. The sphere structure of the present disclosure comprises an inner ball 10. A light source (label omitted) can be disposed on the inner ball 10. Preferably, the light source is a light-emitting-strip module L but is not limited thereto. The light-emitting-strip module L can include a strip-shaped flexible circuit board (label omitted), and a plurality of light-emitting units L1 (as shown in FIG. 1B) disposed on the flexible circuit board. The type of light-emitting units L1 is not limited, and can be self-emitting fluorescent units, or preferably LED units. An electric circuit (not shown in the figures) can be disposed on the flexible circuit board for electrically connecting the light-emitting units L1 of the light-emitting-strip module L and serve as a means for supplying electric power to the light-emitting units L1. Using a baseball as an example, the present disclosure allows light from the light-emitting-strip module L to pass through seam slits 511 on an outer surface 51 of the sphere structure (as shown in FIG. 1C). Light in the sphere structure is transmitted out of the sphere structure through the seam slits 511, such that users can clearly identify the sphere structure under insufficient lighting and no lighting equipment is required.

Referring to FIG. 1A and FIG. 1B, the groove 20 can be formed on the inner ball 10 along a disposing path. The light-emitting-strip module L (light source) can be disposed in the groove 20. In other words, the light-emitting-strip module L is disposed in the groove 20 on the surface of the inner ball 10, and light from the light-emitting-strip module L can pass through the seam slits 511 on the outer surface 51 of the sphere structure and be transmitted out of the sphere structure. By this configuration, light in the sphere structure is transmitted out of the sphere structure through the seam slits 511, such that users can clearly identify the sphere structure according to the present disclosure under insufficient lighting and observe the motion and trajectory of the sphere structure. The containing portion 30 is also formed on the inner ball 10 and extends into the interior of the inner ball 10. The containing portion 30 can accommodate a power supply module (label omitted) which is electrically connected to the light-emitting-strip module L (refer to FIG. 4) for supplying electric power to the light-emitting-strip module L. Preferably, the inner ball 10 is made of natural rubber or synthetic rubber. If the inner ball 10 is made of synthetic rubber, through appropriate chemical synthesis, the volume, weight, hardness, compressibility and elasticity of the synthetic rubber can be adjusted to make the specifications of the sphere structure similar to those of a baseball.

Referring to FIG. 1A, FIG. 1B and FIG. 1C, the first cover layer 50 can cover the inner ball 10, thereby forming the outer surface 51 of the sphere structure. Preferably, the seam slits 511 are arranged proximal to the portion of the outer surface 51 above the groove 20 shown in FIG. 1A and FIG. 1B. By this configuration, the light-emitting-strip module L in the groove 20 can emit light through the seam slits 511. Seam threads 5111 pass through the seam slits 511. In the case of a baseball, the seam threads 5111 are red threads used in hardballs. Additionally, the seam threads 5111 usually do not completely fill the seam slits 511, such that light can pass through gaps of the seam slits 511 without changing the surface structure of the ball. The seam threads 5111 provide a touch and friction similar to those of a typical baseball. In other words, regarding the baseball of the present embodiment, preferably, the seam slits 511 on the outer surface 51 of the first cover layer 50 is arranged according to the pattern of seams on a baseball, and the disposing path of the groove 20 is likewise formed on the inner ball 10 according to the pattern of seams on a baseball, so as to allow light from the light-emitting-strip module L to pass through the seam slits 511 thereby producing the effect of a light-emitting ball.

Additionally, the method of arranging the first cover layer 50 on the inner ball 10 is not limited. In a preferred method, the first cover layer 50 is arranged according to a typical method of arranging leather cover on a baseball (the following is a conventional method of producing leather cover for a baseball in text only, without figures): first cover the inner ball 10 with a leather cover having a contour substantially similar to the number 8 and made of horse hide or cow hide, aligning the edge of the leather cover with the groove 20; then cover the inner ball 10 with another leather cover having a contour substantially similar to the number 8, opposite and rotated 90 degrees with respect to the above leather cover, such that the edges of the two leather covers align to form the abovementioned first cover layer 50. When covering the inner ball 10 with the first cover layer 50, adhesives can be used to fix the first cover layer 50 onto the inner ball 10, and then threads can be stitched at the edges of the two leather covers. Of course, the edges of the two leather covers can be preemptively formed with seam slits, to facilitate subsequent stitching. After stitching the seam threads 5111, the sphere structure of the present disclosure has a similar feel and friction to those of a baseball.

Other than the seam slits 511 of a baseball, in order to transmit light, the outer surface 51 of the sphere structure of the present disclosure can be formed with a light transmitting region (label omitted), such that light from the light source can pass through the light transmitting region out of the sphere structure. The light transmitting region of the present disclosure is not limited. Preferably, the light transmitting region comprises slits (label omitted) on the outer surface 51 arranged proximally to the groove 20. The slits can be a typical slit or the aforementioned seam slits 511 which can be threaded with seam threads 5111.

Additionally, the light transmitting region can be a part of the first cover layer 50. Preferably, the first cover layer 50 has a predetermined thickness through which at least a portion of the light from the light source passes out of the outer surface 51. Therefore, the first cover layer 50 can transmit light. Typical leather for baseballs (but not limited thereto) can partially transmit light due to natural characteristics and thickness, allowing some light therein to pass through without completely shielding the light. Therefore the light transmitting region of the present disclosure can also include the first cover layer 50 or a portion of the first cover layer 50.

Figure 2:
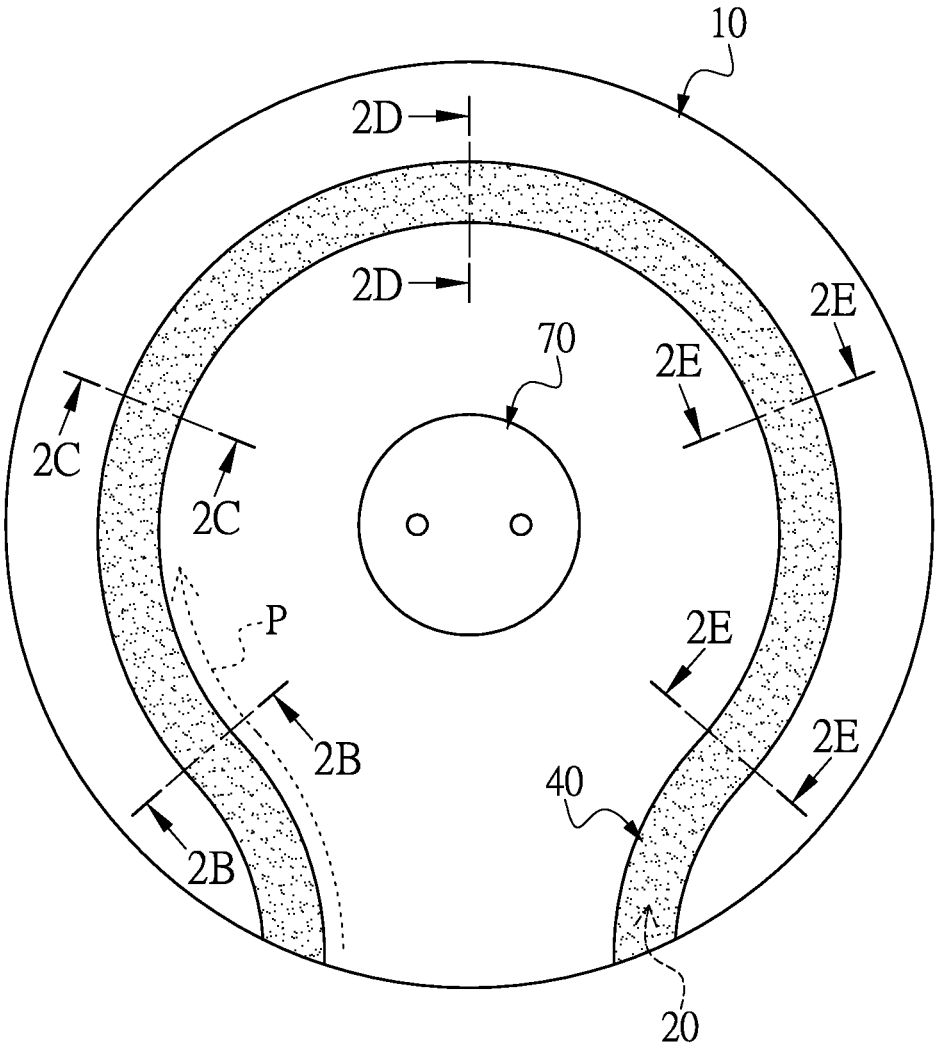
FIG. 2 shows a perspective view of an inner ball assembled with a light guiding unit according to a sphere structure of the present disclosure.
Figure 2A:
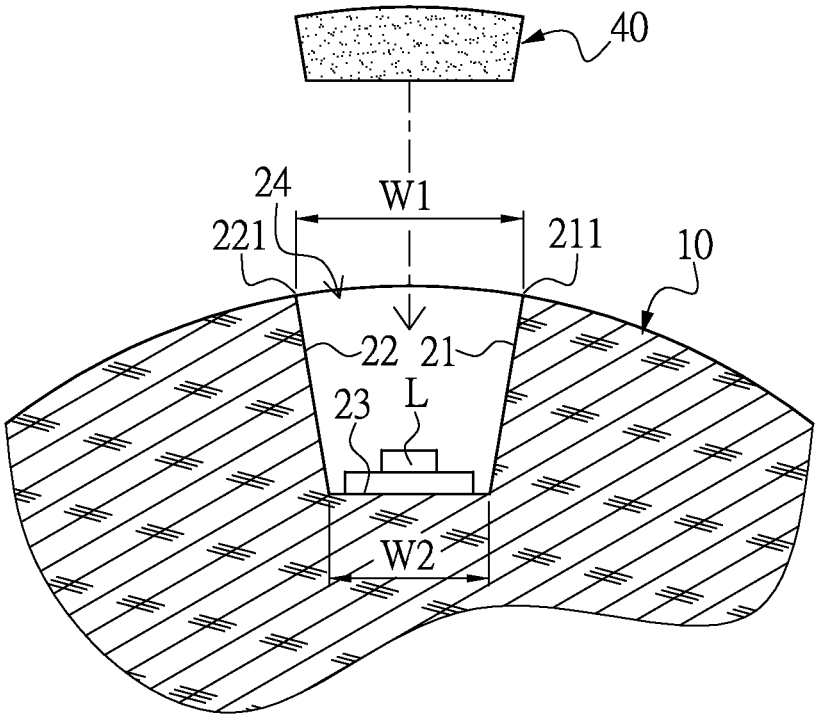
FIG. 2A shows a cross-sectional view of an exploded straight section according to a sphere structure of the present disclosure.
Figure 2B:
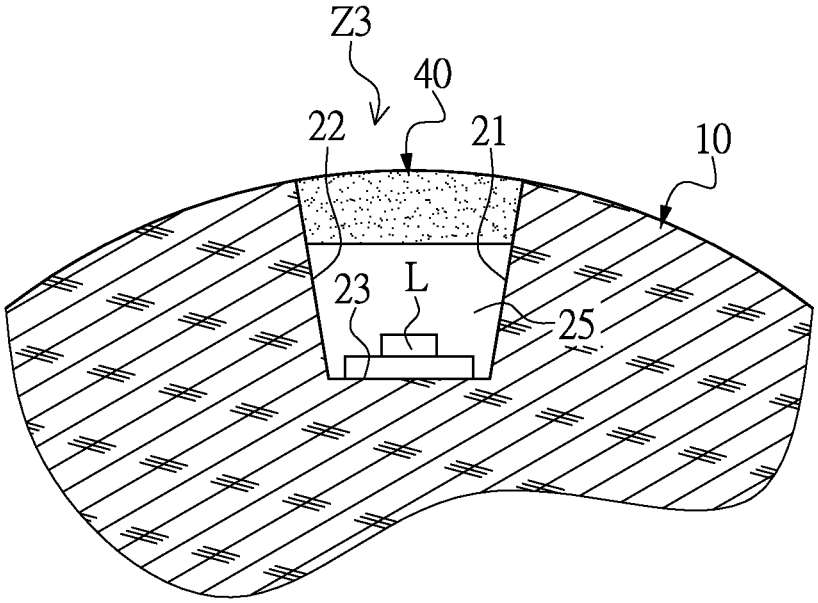
FIG. 2B shows a first cross-sectional view of a straight section according to a sphere structure of the present disclosure.

Referring to FIG. 1B and FIG. 2, a light guiding unit 40 can be disposed in the groove 20, for guiding the light from the light-emitting-strip module L. The material of the light guiding unit 40 can be silicone. Referring to FIG. 2, FIG. 2A, FIG. 2B, the groove 20 includes a first side wall 21, a second side wall 22, and a bottom wall 23. The first side wall 21 and the second side wall 22 extend upward from two sides of the bottom wall 23, respectively, thereby forming the groove 20. The top of the first side wall 21 is a first top portion edge 211. The top of the second side wall 22 is a second top portion edge 221. The first top portion edge 211 and the second top portion edge 221 define a groove opening 24 above the groove 20. A shortest distance between the first top portion edge 211 and the second top portion edge 221 define a groove opening width W1. Additionally, the bottom wall 23 also has a bottom wall width W2. The groove opening width W1 is greater than the bottom wall width W2. Therefore, as shown in FIG. 2A, the groove 20 is substantially shaped like an upside-down trapezoid having a relatively wide groove opening 24 and a relatively narrow bottom wall 23. Given that the light-emitting-strip module L is disposed in the groove 20, the groove opening 24 that is wider than the bottom wall 23 assists in the distribution of light from the light-emitting-strip module L, such that the light emitted by the light source is less easily blocked by the first side wall 21 and the second side wall 22. Additionally, given that the light-emitting-strip module L is disposed in the groove 20, and that the light-emitting-strip module L extends in the groove 20 at the disposing path on the inner ball 10 along the groove 20, the strip-shaped structure of the light-emitting-strip module L facilitates the meandering arrangement of the same in the groove 20.

Figure 2C:
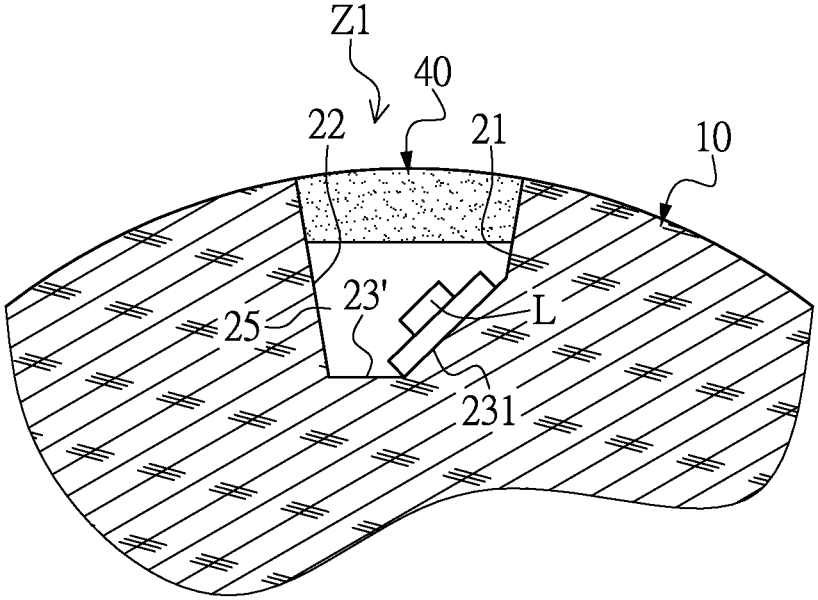
FIG. 2C shows a first cross-sectional view of a first turning section according to a sphere structure of the present disclosure.

Preferably, given that the groove 20 of the inner ball 10 is arranged according to the seams of a baseball, thereby a rightward or straight opening method or opening direction can be formed on the surface of the inner ball 10, referring to FIG. 2 and FIG. 2C, using the path direction along the disposing path P shown in FIG. 2 as a reference on the surface of the inner ball 10, when the groove 20 is still on the surface of the inner ball 10 opening additionally toward a first turning direction (label omitted, using the path direction of the disposing path P as reference, the first turning direction is turning rightward) defined by the first side wall 21, a first turning section Z1 can be defined at the groove 20. Preferably, the first turning section Z1 includes a first slope 231 extending from the bottom wall 23 to the first side wall 21. The normal line of the first slope 231 inclines toward the second side wall 22. In the first turning section Z1, the bottom wall 23' is even smaller than the bottom wall 23 of FIG. 2B due to the first slope 231. The light-emitting-strip module L can be disposed along the first slope 231. When the light-emitting-strip module L in the groove 20 is disposed toward the first turning direction defined by the first side wall 21, the light-emitting-strip module L is attached to the first slope 231 and turns toward the first turning direction (rightward) along the groove 20. Therefore the structure of the first slope 231 assists the secure fixture of the light-emitting-strip module L in the groove 20.

Figure 2D:
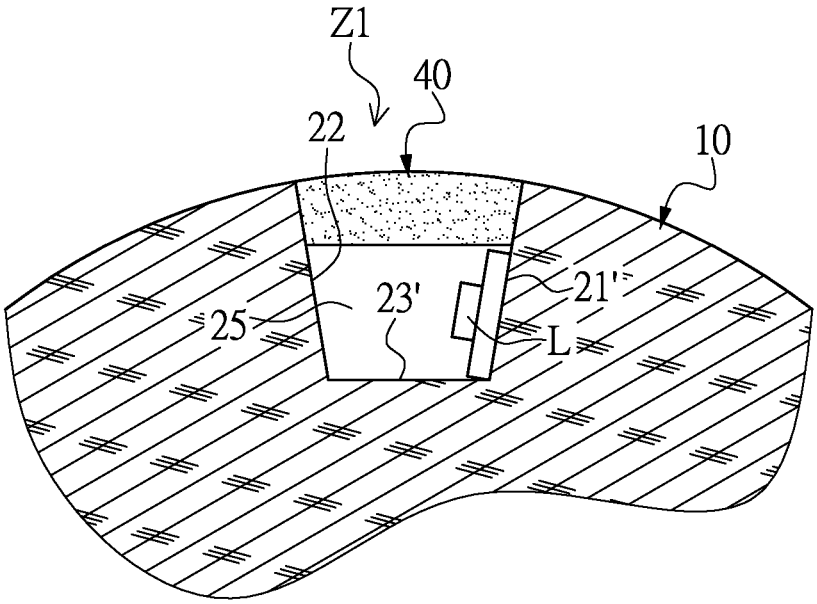
FIG. 2D shows a second cross-sectional view of a first turning section according to a sphere structure of the present disclosure.
Figure 2E:
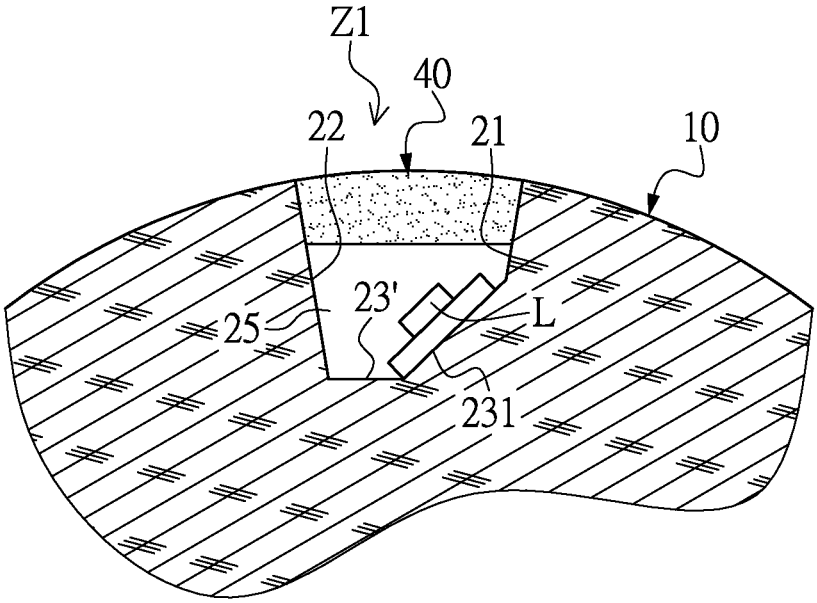
FIG. 2E shows a third cross-sectional view of a first turning section according to a sphere structure of the present disclosure.
Figure 2F:
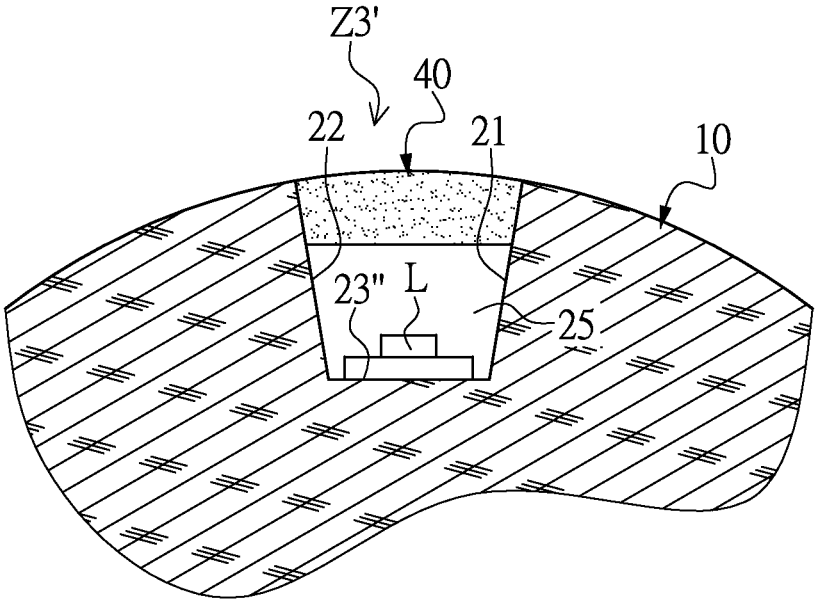
FIG. 2F shows a second cross-sectional view of a straight section according to a sphere structure of the present disclosure.

Please refer to FIG. 2, FIG. 2C and FIG. 2D. The degree of inclination of the first slope 231 in the first turning section Z1 in FIG. 2C (i.e. the slope of the segment between the bottom all 23 and the first side wall 21) can increase as the curvature of the groove 20 in the first turning section Z1 increases, until the slope of the first slope 231 can be the same as the slope of the first side wall 21, i.e. the first slope 231 becomes the first side wall 21', such that the light-emitting-strip module L can be arranged along the first side wall 21' in the first turning section Z1 and flatly disposed in the groove 20. If the light-emitting-strip module L is disposed on the bottom wall 23, curving sideways creates problems of bulging or flipping. Therefore the structure of the first slope 231 or the first slope 231 extending to form the first side wall 21' not only prevents improper arrangement of the light-emitting-strip module L, but also prevents problems of ineffective usage of light source which result from improper arrangement of the light-emitting-strip module L.

Figure 3:
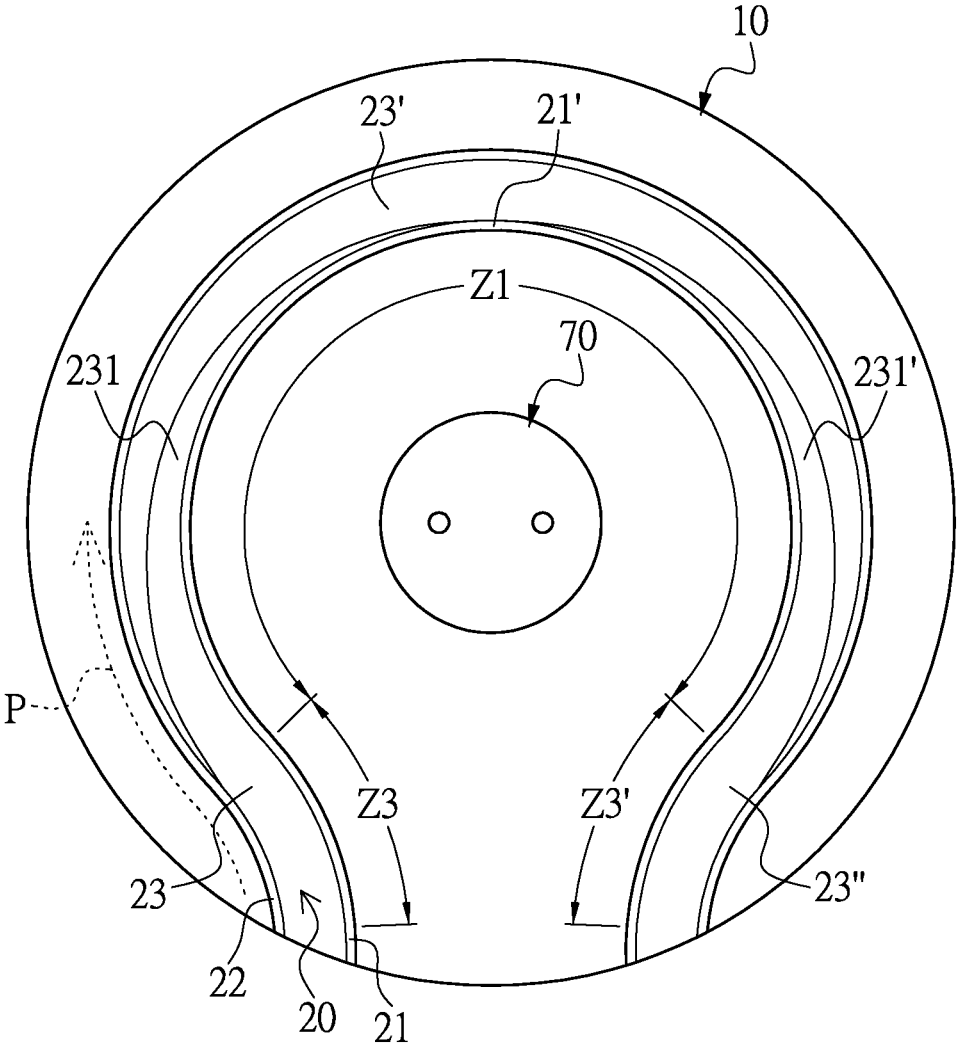
FIG. 3 shows a perspective view of a groove on an inner ball according to a sphere structure of the present disclosure.

Referring to FIG. 2, FIG. 2D, FIG. 2E and FIG. 2F, the first side wall 21' can further extend and when the curvature is smaller, to form the first slope 231' having a smaller slope than the first side wall 23' does. The slope of the first slope 231' gradually decreases in the first turning section Z1 until, as shown in FIG. 3, the first slope 231' becomes the bottom wall 23" after entering a straight section Z3'. The above describes the first turning section Z1 which turns rightward. The groove 20 of the present disclosure can also turn toward a second direction (leftward) defined by the second side wall 22 and define a second turning section (label omitted) in the groove 20. The second turning section likewise can have a second slope (not shown in the figures) analogous to the first slope 231 or extend from the second slope in the second turning section a second side wall (not shown in the figures) whose function is similar to that of the second slope. The first turning section Z1 is similar to the second turning section so the latter is not further described herein.

Referring to FIG. 2, FIG. 2A and FIG. 2B, other than turning rightward in the first turning section Z1 or turning leftward in the second turning section (label omitted), the groove 20 can be formed on the inner ball 10 along a straight path, defining a straight section Z3. The light-emitting-strip module L is disposed on the bottom wall 23 in the straight section Z3. Referring to FIG. 2, FIG. 2B and FIG. 3, when the light-emitting-strip module L is in the straight section Z3 it is disposed on the bottom wall 23. When the light-emitting-strip module L enters the first turning section Z1, it gradually changes from being disposed on the bottom wall 23 to being disposed on the first slope 231 (FIG. 2, FIG. 2C, FIG. 3), then continues along the first slope 231 and changes to being disposed on the first side wall 21' (FIG. 2, FIG. 2D, FIG. 3), then as the curvature of the first turning section Z1 decreases the light-emitting-strip module L changes from being disposed on the first side wall 21' to being disposed on the first slope 231", and finally when entering the straight section Z3 the light-emitting-strip module L gradually changes from being disposed on the first slope 231" to being disposed on the bottom wall 23". In other words, the first slope (231, 231') in the first turning section Z1 can have different slopes according to the degree of curvature of the groove 20 and can become the first side wall 21' or the bottom wall 23". Preferably, as shown in FIG. 2A and FIG. 2B, the light guiding unit 40 can bridge the first side wall 21 and the second side wall 22 of the groove 20, defining with the bottom wall 23 a light source containing space 25, such that the light source containing space 25 can protect the light-emitting-strip module L from outside impact, thereby greatly reducing damage to the light source due to external physical force and allowing the light-emitting-strip module L to be more securely disposed in the groove 20. The light guiding unit 40 can formed by molding and disposed one by one, fixing on the first side wall 21 and the second side wall 22, but is not limited thereto. The light guiding unit 40 can also be directly formed in the groove 20 covering the entire light-emitting-strip module L and filling up the entire groove 20. The light guiding unit 40 can distribute light emitted by the light-emitting-strip module L to the seam slits 511 and out of the outer surface 51, thereby producing a preferred usage of light such that light can be surely transmitted out of the sphere structure.

Figure 4:
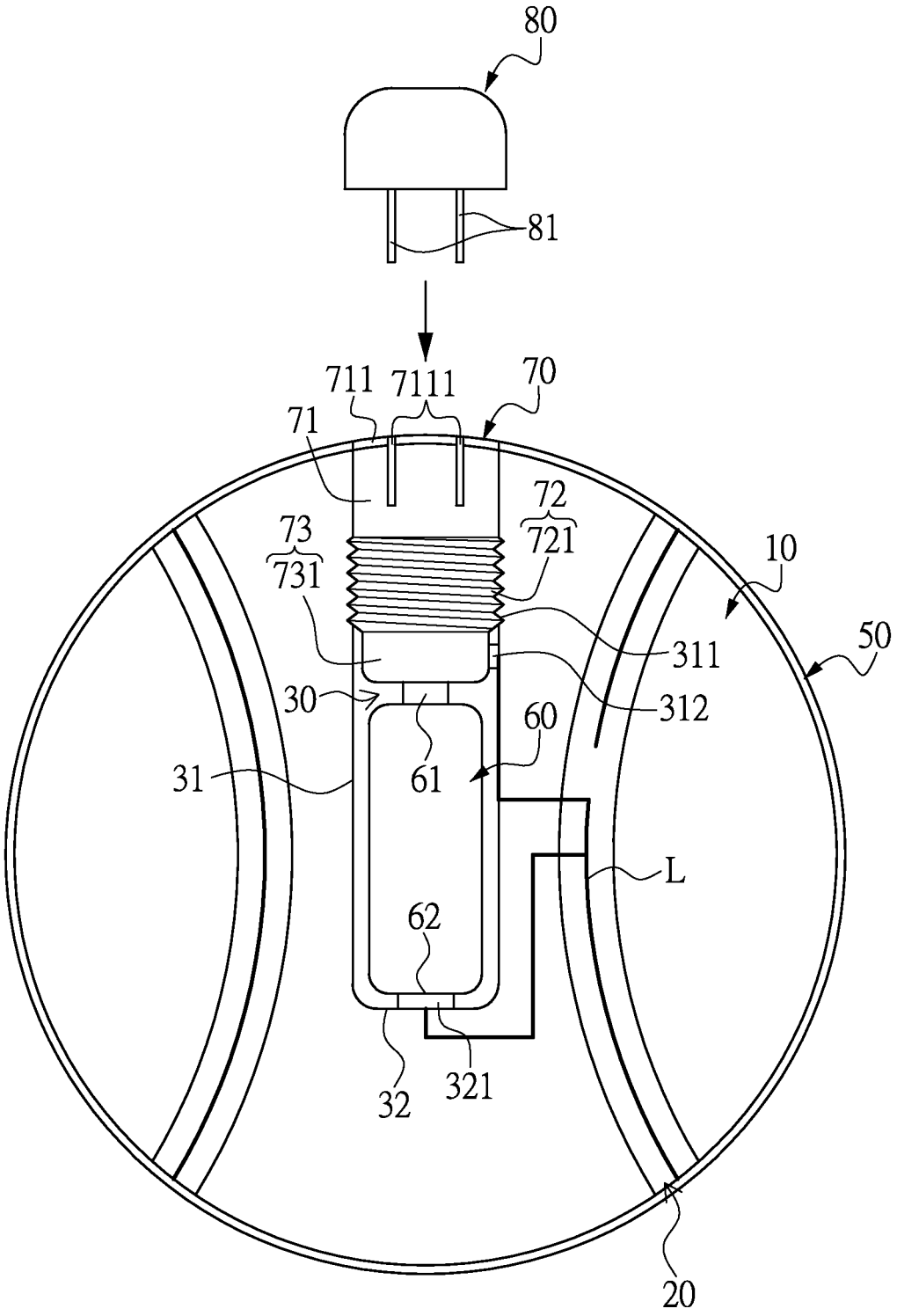
FIG. 4 shows a cross-sectional view of sphere structure accommodating a power supply module according to the present disclosure.

Referring to FIG. 4, the sphere structure of the present disclosure further includes a cover 70 for covering the containing portion 30. A battery 60 can be disposed in the containing portion 30. The cover 70 includes a top portion 71 covered by a second cover layer 711. The second cover layer 711 and the first cover layer 50 are made of substantially the same material and can be joined. The cover 70 includes two female holes 7111 bore from the second cover hole 711 into the cover 70. The female holes 7111 can correspond to a plug 80. The cover 70 has a first screw portion 721 surrounding a surrounding portion 72 of the cover 70. The first screw portion 721 can correspond to a second screw portion 311 formed on a surrounding wall 31 of the containing portion 30. A bottom portion 73 of the cover 70 includes a first conducting portion 731, one end of which can electrically connect a first electrode on the battery 60 to a first conducting unit 312 on the surrounding wall 31. The first conducting unit 312 is in turn electrically connected to the light-emitting-strip module L. A second conducting portion 321 on a containing bottom portion 32 of the containing portion 30 can be electrically connected a second electrode 62 of the battery 60 to the light-emitting-strip module L, thereby together with the first electrode 61 electrically connecting to the light-emitting-strip module L and supplying the light-emitting-strip module L with electrical power. Of particular note, given that the diameter of the female holes 7111 is small, unlike typical slot or Phillips screw heads, the female holes 7111 of the cover 70 minimizes the effect on the surface of the sphere structure. The female holes 7111 can be inserted with male portions 81 of the plug 80 and then turned to lock the cover 70 into or unlock the cover 70 from the containing portion 30. The power supply module of the present disclosure includes the cover, the containing portion 30, the battery 60 and relationships of connections therebetween.

In summary of the above, the sphere structure of the present disclosure is not only suitable for baseballs, but also to other balls having seams on their surfaces, e.g. rugby balls. Through the sphere structure of the present disclosure, a light source disposed inside can be transmitted out of the balls through the seam slits, solving the problem of using balls in an environment of insufficient lighting.

The descriptions illustrated supra set forth simply the preferred embodiments of the present disclosure; however, the characteristics of the present disclosure are by no means restricted thereto. All changes, alternations, or modifications conveniently considered by those skilled in the art are deemed to be encompassed within the scope of the present disclosure delineated by the following claims.

What is claimed is:

1. A sphere structure configured to accommodate a light source at an inner ball of the sphere structure, and comprising:

a groove, formed on the inner ball along a disposing path, for accommodating the light source;

a containing portion, formed on the inner ball for accommodating a power supply module configured to be electrically connected to the light source; and a first cover layer covering the inner ball, forming an outer surface on the sphere structure, wherein at least a portion of the outer surface is a light transmitting region for transmitting light from the light source to outside of the sphere structure.

2. The sphere structure according to claim 1, wherein the groove includes a bottom wall, a first side wall and a second side wall, the first side wall and the second side wall extend upward from two sides of the bottom wall respectively to form the groove, the top of the first side wall is a first top portion edge, the top of the second side wall is a second top portion edge, the first top portion edge and the second top portion edge define a groove opening, a shortest distance between the first top portion edge and the second top portion edge define a groove opening width, the bottom wall has a bottom wall width, the groove opening width is greater than the bottom wall width.

3. The sphere structure according to claim 2, wherein the groove opens toward a first turning direction defined by the first side wall defining a first turning section of the groove, the first turning section includes a first slope extending from the bottom wall to the first side wall, and the light source is disposed on the first slope in the first turning section.

4. The sphere structure according to claim 2, wherein the groove opens toward a first turning direction defined by the first side wall defining a first turning section of the groove, and the light source is disposed on the first side wall in the first turning section.

5. The sphere structure according to claim 2, wherein the groove opens toward a second turning direction defined by the second side wall defining a second turning section of the groove, the second turning section includes a second slope extending from the bottom wall to the second side wall, and the light source is disposed on the second slope in the second turning section.

6. The sphere structure according to claim 2, wherein the groove opens toward a second turning direction defined by the second side wall defining a second turning section of the groove, and the light source is disposed on the second side wall in the second turning section.

7. The sphere structure according to claim 2, wherein the groove is formed on the inner ball in a straight direction defining a straight section of the groove, and the light source is disposed on the bottom wall in the straight section.

8. The sphere structure according to claim 1, wherein a light guiding unit is disposed in the groove for guiding light emitted by the light source to the light transmitting region and out of the outer surface.

9. The sphere structure according to claim 8, wherein the light guiding unit bridges the first side wall and the second side wall of the groove defining a light source containing space, the light source is arranged in the light source containing space and protected by the light source containing space from external impact and damage.

10. The sphere structure according to claim 1, wherein the light source is a light-strip-emitting module having a plurality of light-emitting units.

11. The sphere structure according to claim 1, wherein the sphere structure further includes a cover, and the cover includes:

a top portion having a second cover layer joined to the first cover layer;

at least two female holes bore from the second cover layer into the cover, for engaging a plug;

a first screw portion surrounding a surrounding portion of the cover for engaging a second screw portion of a surrounding wall of the containing portion; and a cover bottom portion having a first conducting portion, one end of which is configured to electrically connect a first electrode of a battery to a conducting unit on the surrounding wall, and be electrically connected to the light source through the first conducting unit, and a second conducting portion on a containing bottom portion of the containing portion is configured to electrically connect a second electrode of the battery to the light source, to be electrically connected to the light source together with the first electrode.

12. The sphere structure according to claim 1, wherein the light transmitting region is slits formed along a portion of the outer surface proximal to the groove.

13. The sphere structure according to claim 12, wherein the slits are seam slits threaded with a seam thread.

14. The sphere structure according to claim 1, wherein the light transmitting region is a part of the first cover layer, the first cover layer has a predetermined thickness, the predetermined thickness allows at least a portion of light from the light source to pass through the first cover layer out of the outer surface.

* * * * *